US006698959B2

(12) United States Patent
Kaya

(10) Patent No.: US 6,698,959 B2
(45) Date of Patent: Mar. 2, 2004

(54) PRINTER FOR PRINTING PAPER ROLL HAVING A POSITION REGULATING DEVICE

(75) Inventor: Akimasa Kaya, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 275 days.

(21) Appl. No.: 10/012,498

(22) Filed: Dec. 12, 2001

(65) Prior Publication Data

US 2002/0096075 A1 Jul. 25, 2002

(30) Foreign Application Priority Data

Dec. 13, 2000 (JP) ..... 2000-379363

(51) Int. Cl.[7] ..... B41J 11/26; B65H 26/00; B65H 16/02; B65H 16/06

(52) U.S. Cl. ..... 400/613; 242/563; 242/595.1; 242/596.1; 242/417.3

(58) Field of Search ..... 400/613, 88, 708; 242/563, 595.1, 596.1, 417.3; 355/72

(56) References Cited

U.S. PATENT DOCUMENTS 5,187,531 A * 2/1993 Ozawa et al. ..... 355/72
5,684,570 A * 11/1997 Larsen ..... 355/72
5,906,333 A * 5/1999 Fortuna et al. ..... 242/554.5
5,918,989 A * 7/1999 Stout et al. ..... 400/88
6,367,731 B1 * 4/2002 Takizawa et al. ..... 242/417.3
D475,751 S * 6/2003 Kolls et al. ..... D20/8

* cited by examiner

*Primary Examiner*—Andrew H. Hirshfeld
*Assistant Examiner*—Wasseem H. Hamdan
(74) *Attorney, Agent, or Firm*—Sughrue Mion, PLLC

(57) ABSTRACT

A loading lid is provided with a roll holding mechanism. The roll holding mechanism is constituted of a holder plate, a first position regulate section and a second position regulate section. The holder plate and the loading lid are attached to a same shaft. The holder plate is biased by a spring toward the loading lid. After the printing paper roll is put on the loading lid, it is closed. On closing the loading lid, as it relatively moves to the holder plate, an open angle between the loading lid and the holder plate becomes smaller gradually. When first and second positioning plates and the holder plate contact to a periphery of the paper roll, the loading lid stops relatively moving to the holder plate. Thereafter, the loading lid and the holder plate move together while they keep the open angle in accordance with the largeness of the radius of the paper roll. When the loading lid is perfectly closed, a center of a roll core is set at a predetermined position, regardless of the largeness of the paper roll. The paper roll is rotatably supported by roll supporting shafts.

10 Claims, 7 Drawing Sheets

PRINTER FOR PRINTING PAPER ROLL HAVING A POSITION REGULATING DEVICE

BACKGROUND OF THE INVENTION

1. Field of the Invention

The present invention relates to a printer for a printing paper roll, and more particularly to a printer in which the printing paper roll is easily loaded.

2. Description Related to the Prior Art

Among several kinds of printing paper or recording paper for a printer, there is a printing paper roll (hereafter paper roll), in which a long continuous printing paper is rolled around a roll core. The paper roll is loaded through a paper feed magazine of the printer, or directly into a paper roll chamber of the printer. The paper feed magazine or the paper roll chamber has a pair of frames, on which bearings, for example openings, are formed for supporting the shaft. When the paper roll is loaded, the shaft is fitted in a hole of the roll core to rotatably support the paper roll between the frames. Further, there is also another type of loading for the paper roll, in which paper holders are attached to both ends of the roll core such that the shaft protruding from the paper holders is inserted in the openings of the frames.

However, in the apparatus described above, the shaft has to be inserted in the bearings after the shaft is inserted in or the paper holder is attached to the roll core. Accordingly, it is hard to load the paper roll. Further, the radius of the paper roll may be reduced if it has been already used. Namely, the paper roll of a smaller radius is often loaded in the printer. Thereby, the chucking of the paper roll in the printer is troublesome.

SUMMARY OF THE INVENTION

A main object of the present invention is to provide a printer for a printing paper roll which can be easily loaded.

Another object of the present invention is to provide a printer for the printing paper roll in which the chucking of the printing paper roll in the printer is always carried out even if the radius of the printing paper roll is different.

In order to achieve the above and other objects, a printer for a printing paper roll of the present invention includes an openable loading lid, and a holder plate attached to the loading lid. An open angle between the loading lid and the holder plate is determined in accordance with a radius of the printing paper roll. A position of the printing paper roll relative to the loading lid is determined in accordance with the open angle.

A positioning device has first and second link mechanisms attached to the loading lid and the holder plate. The first and second link mechanisms include first and second positioning plates to contact to a periphery of the printing paper roll. After the printing paper roll is put on the loading lid, the loading lid is closed. Thereby the loading lid relatively moves to the holder plate, and the open angle becomes smaller. When the periphery of the printing paper roll contacts to the first and second positioning plates and the holder plate, the open angle decreases no more. Then, the loading lid and the holder plate move together with the certain open angle while the printing paper roll is held between them. The loading lid and the holder plate are rotatable, and preferably provided on a same shaft.

When the loading lid is set at a closed position, a detector generates a detection signals. Beside on the detection signal, a roll supporting device is driven. The roll supporting device slides a first or second support shaft to chuck and rotatably support the printing paper roll at a predetermined position.

According to the invention, the chucking of the printing paper roll is carried out when the loading lid is closed after putting the printing paper roll on it. Further, the loading lid is perfectly closed, a shaft hole of the printing paper roll is at a predetermined position, independent of changing of the radius of the printing paper roll. Therefore, the printing paper rolls having different radiuses can be surely chucked.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
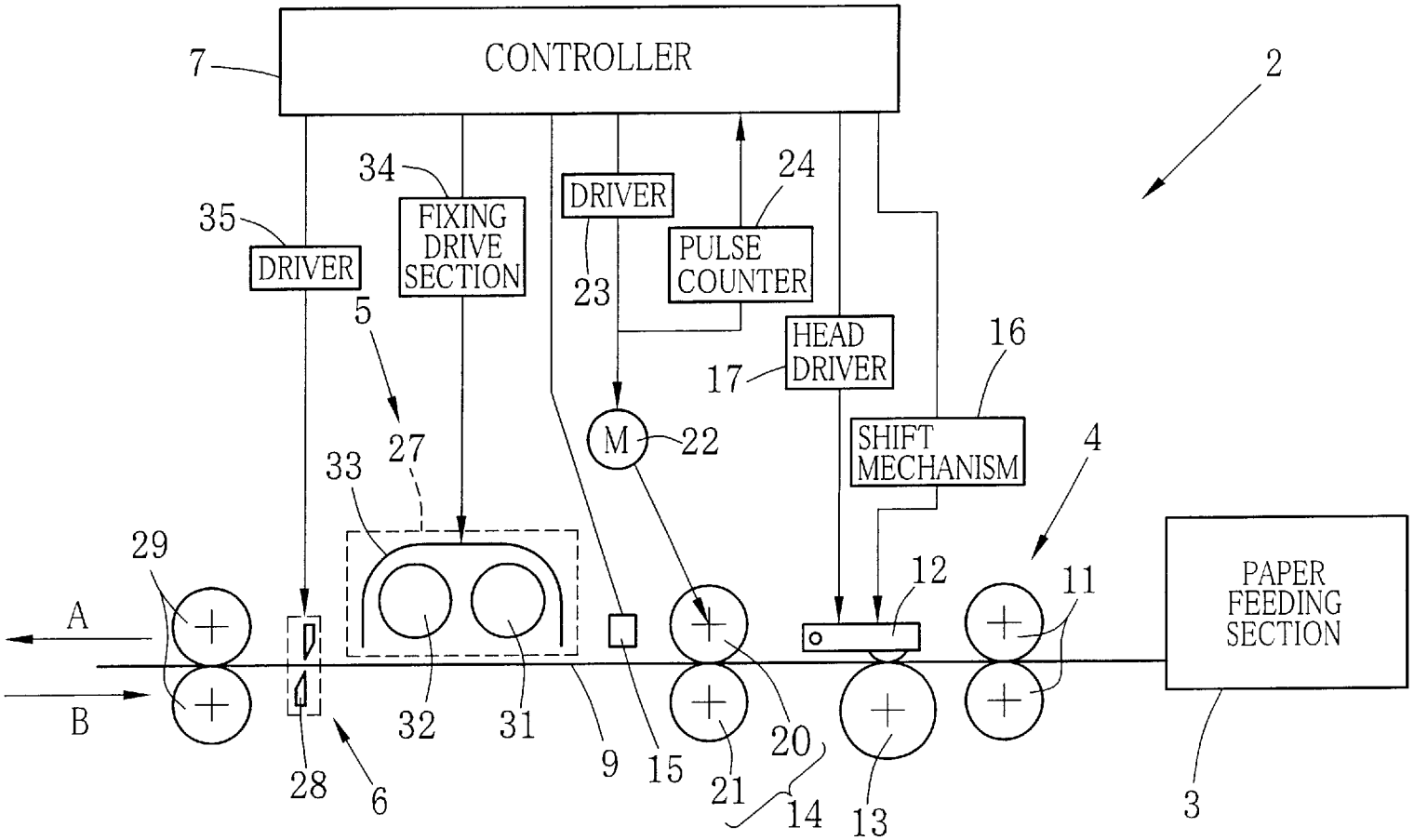
FIG. 1 is a schematic diagram illustrating a thermosensitive color printer of the present invention.

In FIG. 1, the thermosensitive color printer 2 is constructed of a paper feeding section 3, a printing section 4, a fixing section 5, a cutting section 6 and a controller 7. In the thermosensitive color printer 2, a thermosensitive color printing paper 8 is used. The printing section 4 is constructed of a first feed roller pair 11, a thermal head 12, a platen roller 13, a second feed roller pair 14 and a paper sensor 15, and they are disposed one by one in a feed direction A. The thermal head 12 is attached to a shift mechanism 16. The shift mechanism 16 shifts the thermal head 12 into a printing position when printing is carried out, and into a retracted position when printing is not carried out. In the printing position, the thermal head 12 contact to the thermosensitive color printing paper 8 with an adequately pressure, and in the retracted position, the thermal head 12 is pulled up not so as to contact with the thermosensitive color printing paper 8. Further, the platen roller 13 is confronted to the thermal head 12 to support the thermosensitive color printing paper 8 from a rear side thereof. The numerous 17 shows a head driver.

The second feed roller pair 14 consists of a capstan roller 20 and a nip roller 21. The paper sensor 15 detects an end of the thermosensitive color printing paper 8, and sends a detection signal to the controller 7. The controller 7 controls a driver 23 to drive the pulse motor 22. When a pulse motor 22 causes to rotate the capstan roller 20 in a clockwise direction, the thermosensitive color printing paper 8 is fed in the feed direction A, and thereby, printing on each coloring layer of the thermosensitive color printing paper 8 is carried out with the thermal head 12. Further, when the pulse motor 22 causes the capstan roller 20 to rotate in a counterclockwise direction, the thermosensitive color printing paper 8 is fed in a feed back direction B, and prepare for printing on the next thermosensitive coloring layers.

The number of drive pulses is counted by a pulse counter 24 in order to control the pulse motor 22. Based on the drive pulses, the controller 7 determines positions for starting printing, feeding back the color printing paper and cutting. The pulse counter 24 counts up the number of the drive pulse when the pulse motor 22 causes the capstan roller 20 in the clockwise direction, and the pulse counter 24 counts down the number of the drive pulse when the pulse motor 22 causes the capstan roller 20 in the counterclockwise direction.

A fixing device 27, a cutter 28 and a paper feed roller pair 29 are disposed downstream from the thermal head 12 one by one along the feed direction A. The fixing device 27 is constituted of a yellow fixing lamp 31, a mazenta fixing lamp 32, a reflector 33 and a fixing drive section 34. The yellow fixing lamp 31 emits a violet light whose wave length is at the peak about 420 nm. The mazenta fixing lamp 32 emits a ultraviolet ray whose wave length is at the peak about 365 nm. When yellow images are printed, the controller 7 causes the yellow fixing lamp 31 through the fixing drive section 34 to emit the violet light. Further, when mazenta images are printed, the controller 7 causes the mazenta fixing lamp 32 through the fixing drive section 34 to emits the ultraviolet ray. While cyan images are printed, the mazenta fixing lamp 32 continues to emit the ultraviolet ray in order to bleach unprinted areas slightly colored yellow.

The controller 7 controls the cutter 28 through the driver 35 to cut the thermosensitive color printing paper 8 into a sheet. The paper feed roller pair 29 feeds the sheets through an outlet.

Figure 2:
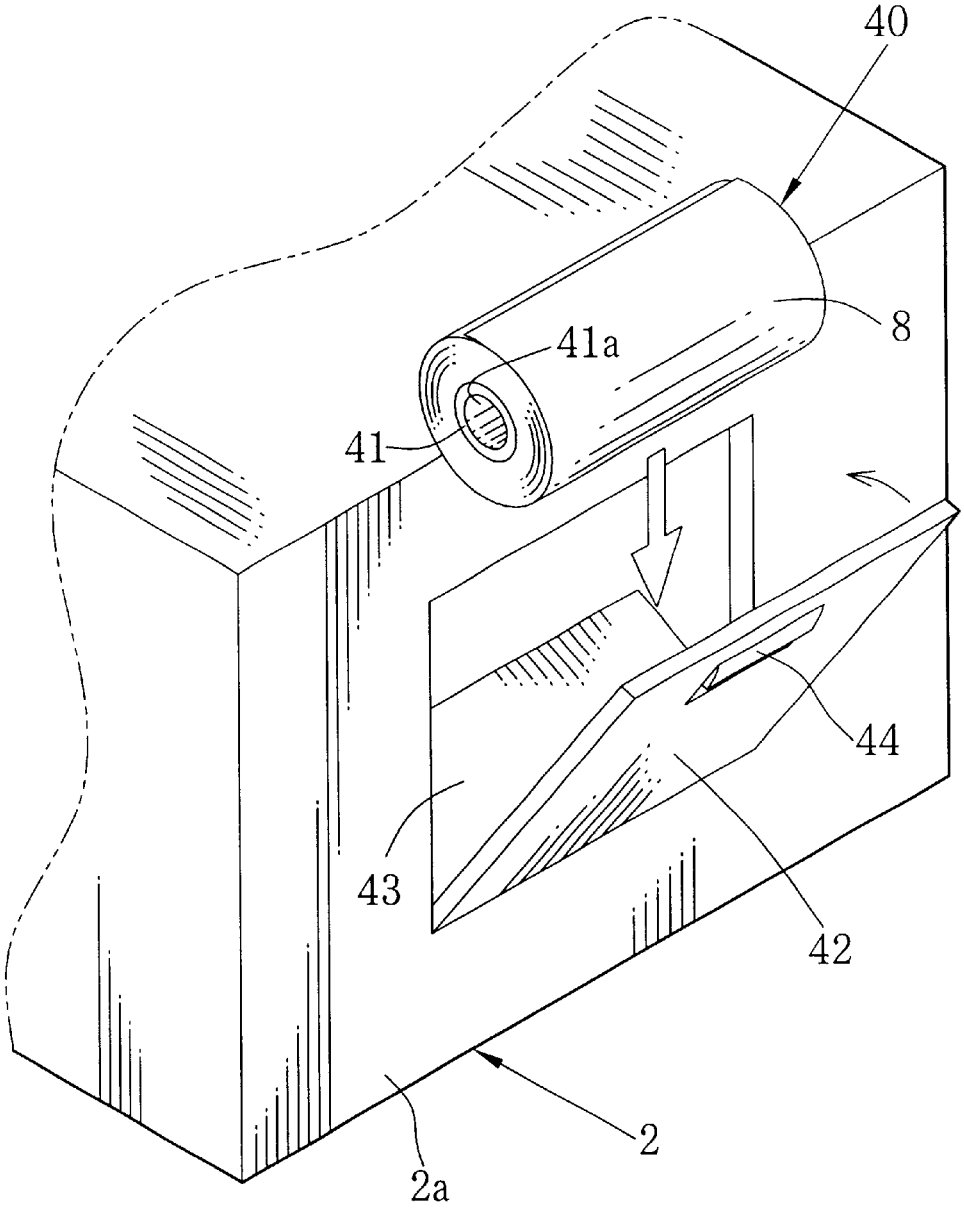
FIG. 2 is a perspective view when a paper roll is loaded in the thermosensitive color printer.

As shown in FIG. 2, a printing or recording paper roll (hereafter paper roll) 40 is used in the thermosensitive color printer 2. In the paper roll 40, the thermosensitive color printing paper 8 is rolled around a roll core 41 made of plastic or paper. When the paper roll 40 is sold, an edge thereof is fixed with an adhesive tape. Further, it is packed in a package, such as a bag and a box having a moisture proof characteristic and a light-shielding property. In order to begin to use the paper roll 40, it is withdrawn from the package and loaded in the paper feeding section 3.

The thermosensitive color printer 2 includes a printer body 2*a*. In the printer body 2*a*, printing mechanisms, for example, the paper feeding section 3, the printing section 4, the fixing section 5 and the cutting section 6, are contained. A front face of the printer body 2*a* is provided with a loading lid 42. In order to load the paper roll 40, a grip 44 is caught with a hand and pulled forwards to open the loading lid 42. Then, the paper roll 40 is put on the loading lid 42. Inside of the loading lid 42, a holder plate 43 is rotatably attached and constructs a part of the paper feeding section 3, in combination with the loading lid 42. Then, the paper roll 40 is supported by the loading lid 42 and the holder plate 43. When the loading lid 42 is closed, the paper roll 40 is loaded in the paper roll feed section 3.

Figure 3:
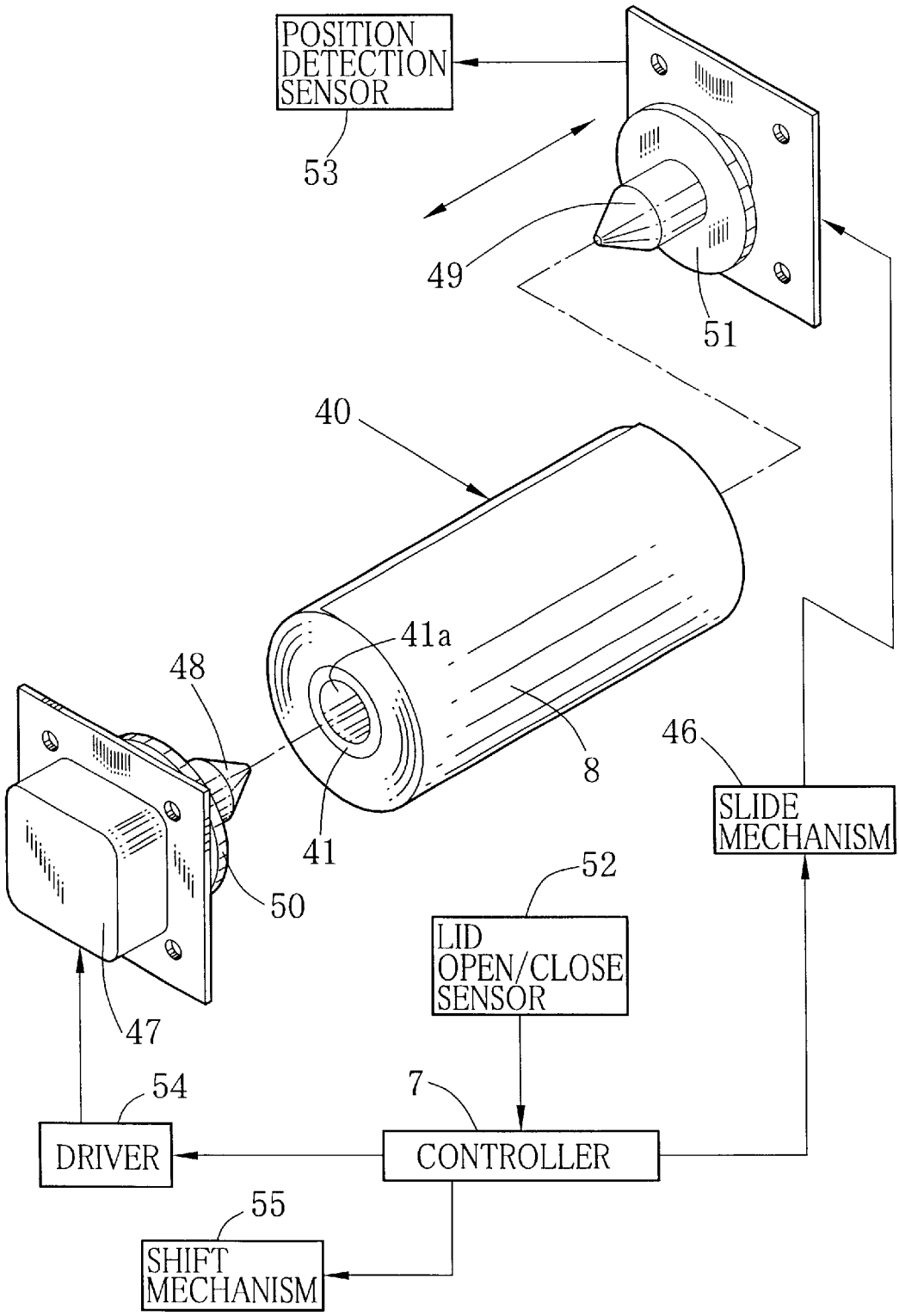
FIG. 3 is a perspective view illustrating a structure of a paper feeding section.

As shown in FIG. 3, in the paper feed section 3, paper roll support shafts, a slide mechanism 46 and the like are disposed. The paper roll shaft is deposited at a predetermined position and constituted of a drive shaft 48 and a driven shaft 49 which are arranged in a line. The drive shaft 48 is caused by a drive motor 47 to rotate, and the driven shaft 49 is slid toward the drive shaft 48 by the slide mechanism. The drive shaft 48 and the driven shaft 49 are plastic molded articles and, and their ends have a cone-shaped form. Further, flanges 50, 51 are formed on the drive shaft 48 and the driven shaft 49 in order that a side edge of the paper roll 40 does not have a volute form.

When the loading lid 42 is perfectly closed, a lid open/close sensor 52 generates detection signals. Corresponding to the detection signals, the controller 7 controls the slide mechanism 46 to slide the driven shaft 49 towards the paper roll 40 at a predetermined position. The driven shaft 49 enters into a hole 41*a* of the roll core 41 of the paper roll 40. Thereby, the flange 51 presses the paper roll 40 towards the drive shaft 48 such that the drive shaft 48 may be entered into the hole 41*a* of the roll core 41. Thus the paper roll 40 is supported by the paper roll shaft between flanges 50 and 51. When a position detection sensor 53 detects that the paper roll shaft supports the paper roll 40, the controller 7 causes the slide mechanism 46 to stop. The numeral 54 shows a driver.

Figure 4:
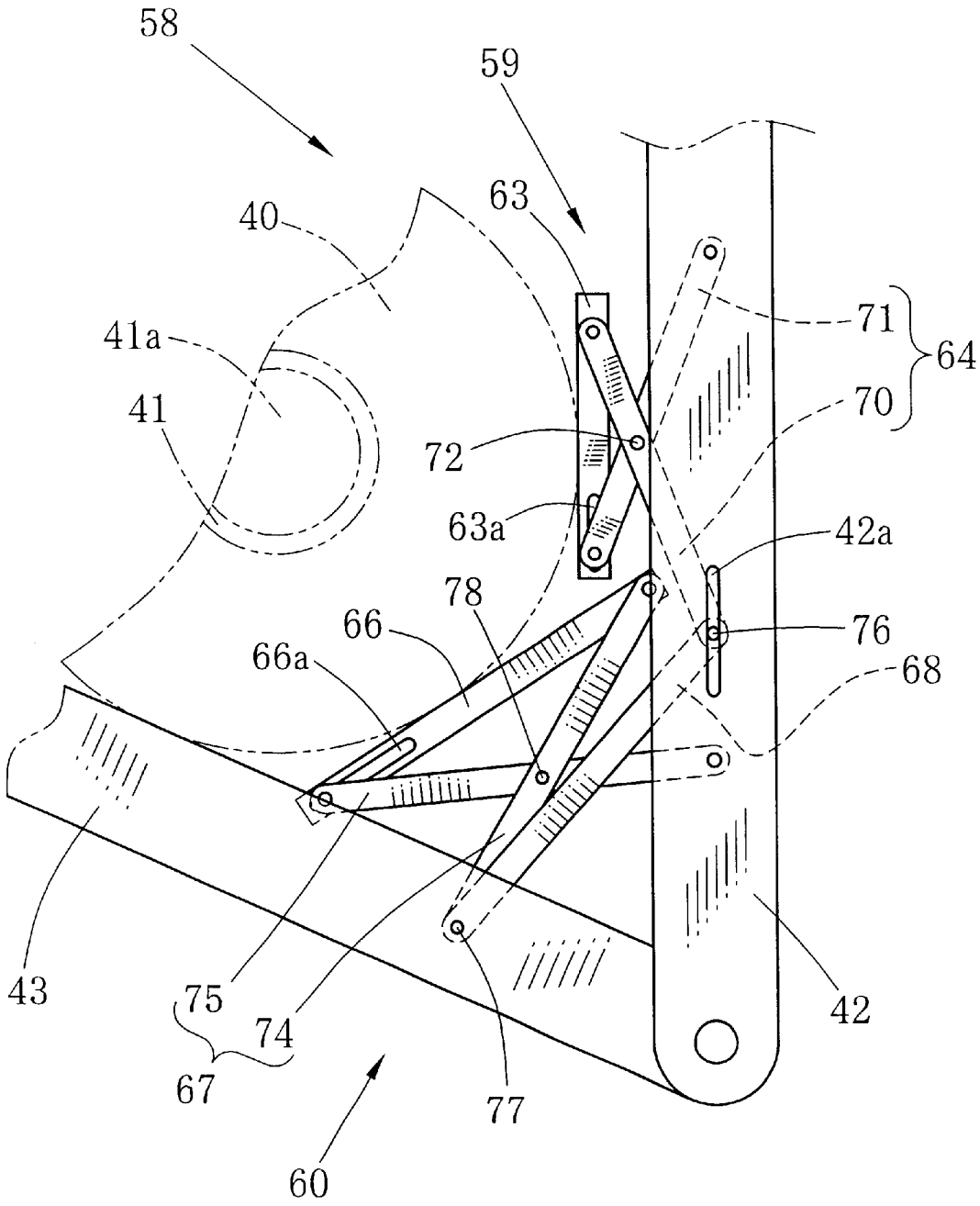
FIG. 4 is a side view illustrating a structure of a paper roll holding mechanism.

As shown in FIG. 4, a roll holding mechanism 58 is attached inside the loading lid 42. The roll holding mechanism 58 is constituted of the holder plate 43, a first position regulate section 59 and a second position regulate section 60. The holder plate 43 is coaxially attached with the loading lid 42, and urged to a stopper 62 by a spring 61 (see FIG. 5). The holder plate 43 is rotated by a shift mechanism 55 (see FIG. 6) in a counterclockwise direction against bias of a spring, after the drive shaft 48 and the driven shaft 49 enter in the hole 41*a* of the roll core 41.

The first position regulate section 59 is constituted of a positioning plate 63 and a link mechanism (pantograph mechanism) 64 and a connection link 68. The second position regulate section 60 is constituted of a positioning plate 66 and a link mechanism (pantograph mechanism) 67. Positions of the first and second positioning plates 63, 66 are determined corresponding to an angle between the loading lid 42 and the holder plate 43.

The link mechanism 64 is constructed of rotary links 70, 71. An end of the rotary link 70 is connected to the positioning plate 63. Another end of the rotary link 70 contacts to the end of the connection link 68, and they are connected with a pin 76 which is slidably fitted in a groove 42*a* formed in the loading lid 42. An end of the rotary link 71 is connected to the loading lid 42, and another end thereof is slidably fitted in a groove 63*a* of the positioning plate 63 with a pin. The rotary links 70, 71 cross, and they are connected to each other with a pin 72.

The link mechanism 67 is constructed of rotary links 74, 75. An end of the rotary link 74 is connected to the positioning plate 66. Another end of the rotary link 74 contacts to the end of the connection link 68, and a pin 77 provided through them is connected to the holder plate 43. An end of the rotary link 75 is connected to the loading lid 42, and another end thereof is slidably fitted in a groove 66*a* of the positioning plate 66 with a pin. The rotary links 74, 75 cross, and they are connected to each other with a pin 78.

Figure 5:
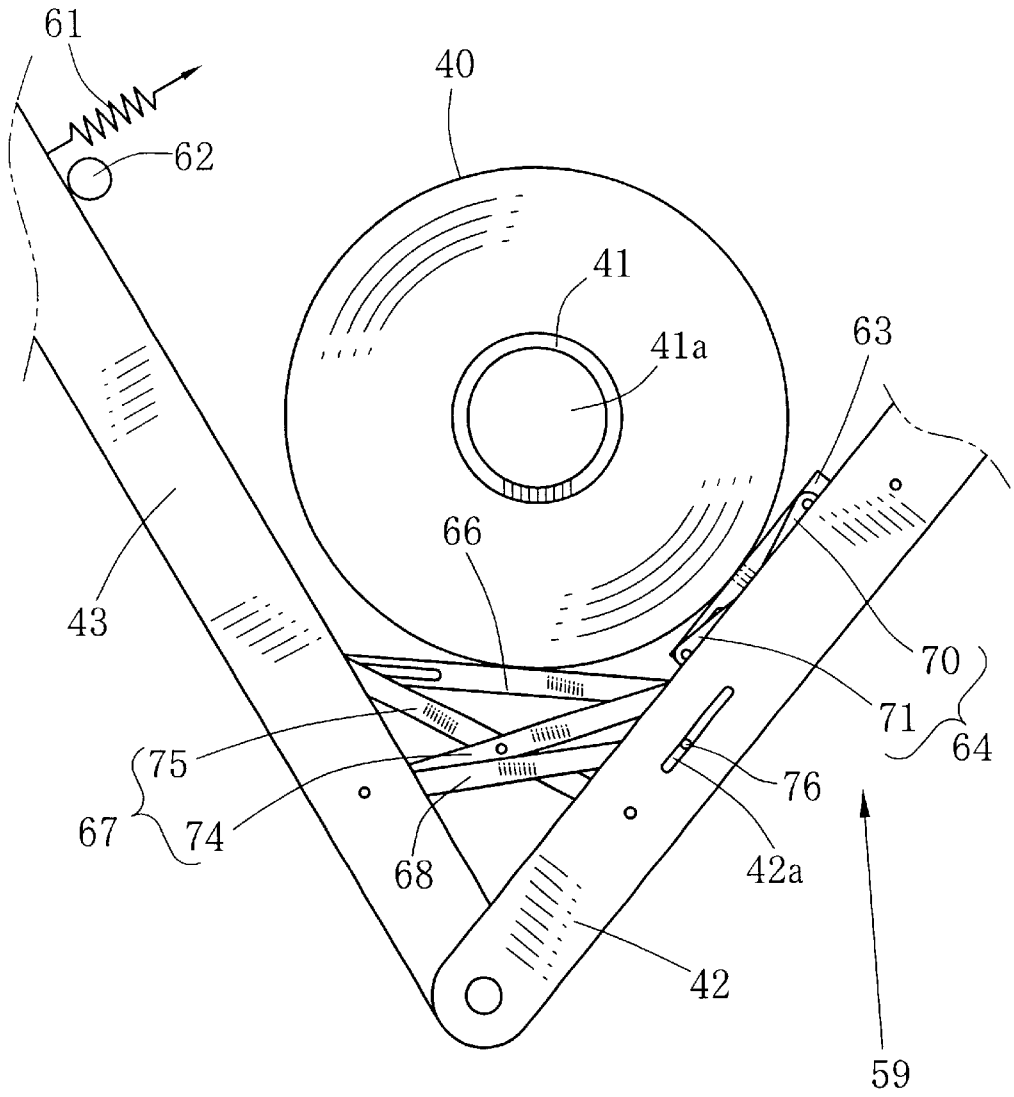
FIG. 5 is a side view of the paper roll holding mechanism illustrating a situation when the paper roll is put on a loading lid.
Figure 6:
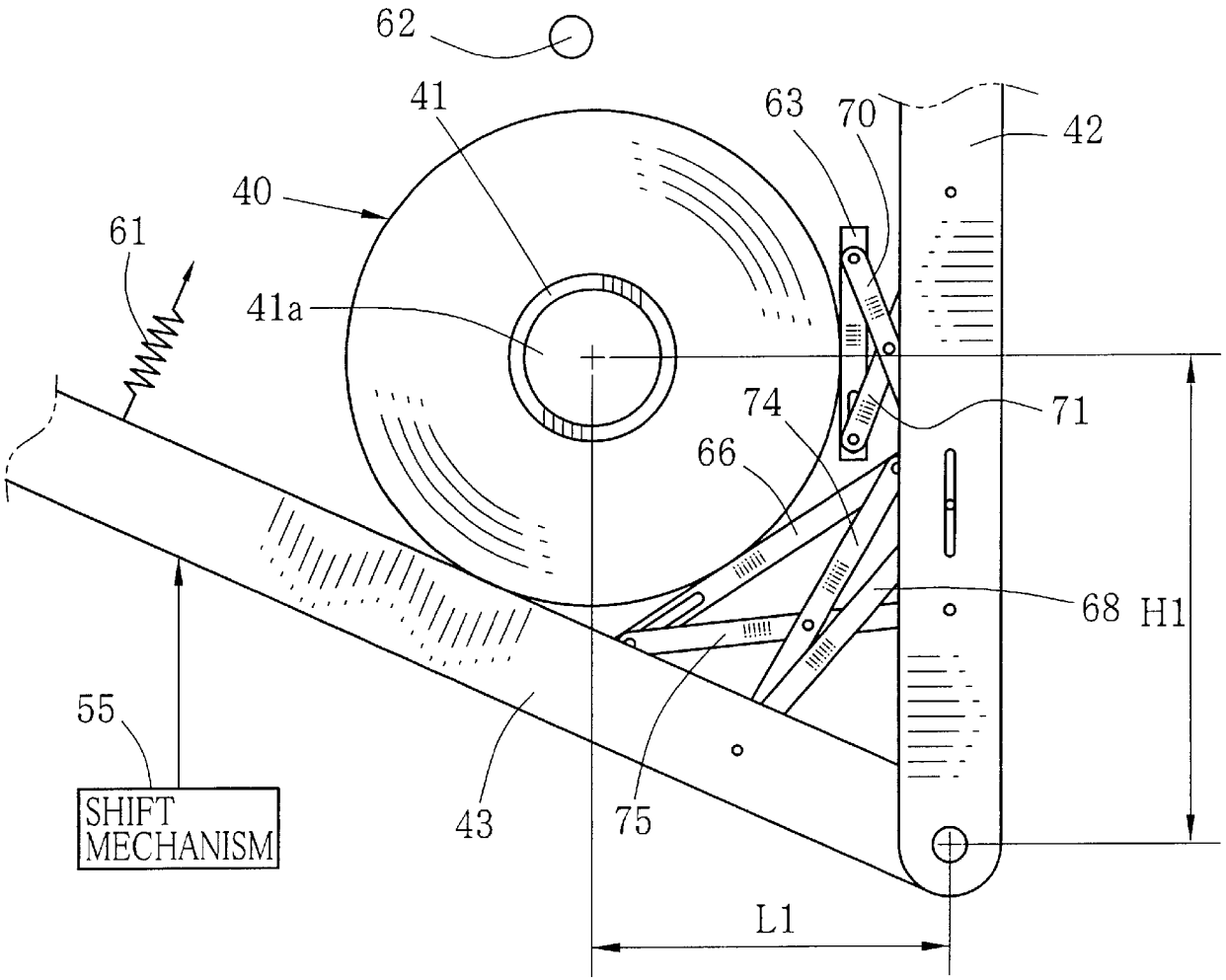
FIG. 6 is a side view of the paper roll holding mechanism illustrating a situation when the paper roll which is not used is put on the loading lid.
Figure 7:
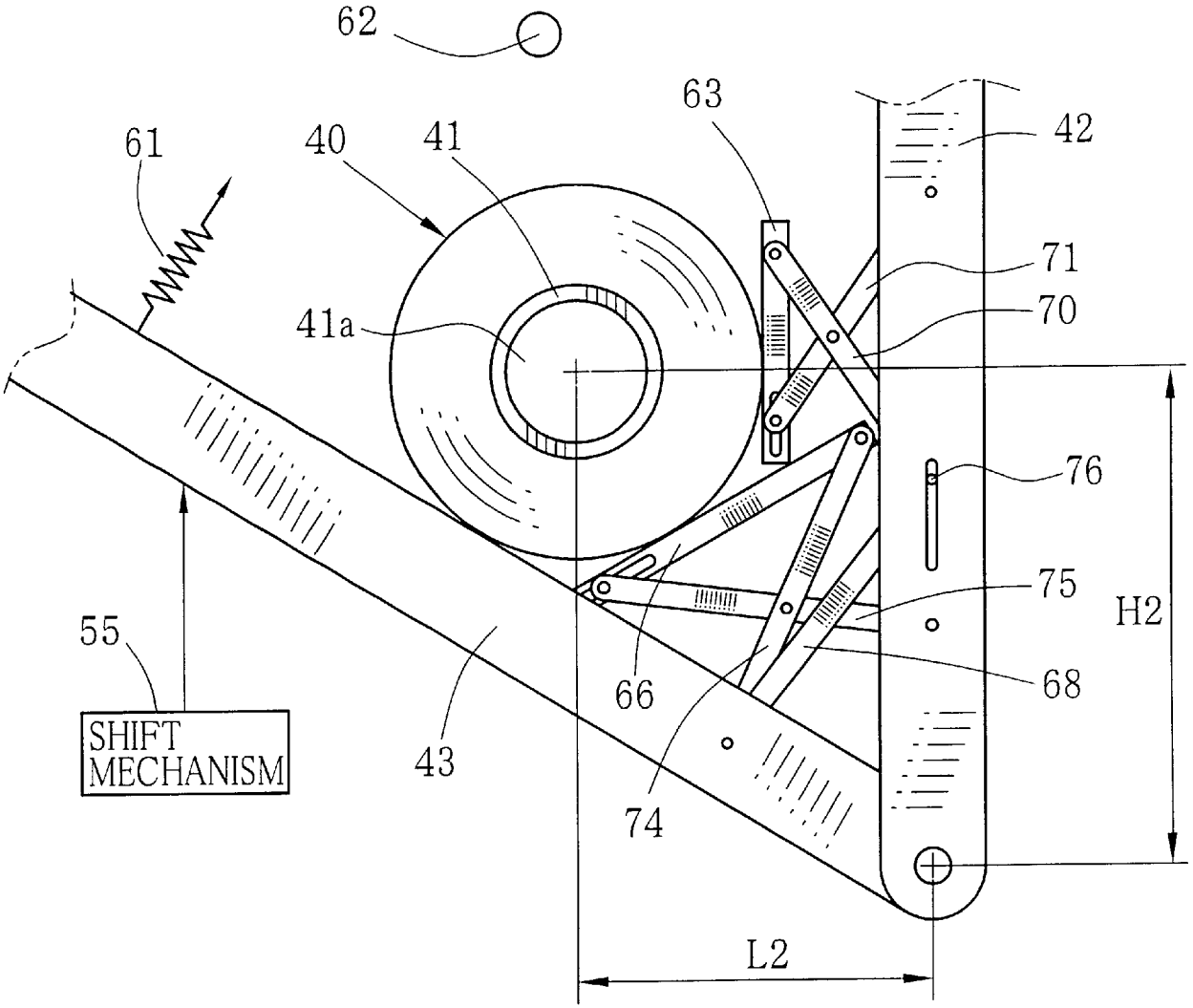
FIG. 7 is a side view of the paper roll illustrating a situation when the paper roll which has been already used is put on the loading lid.

According to the roll holding mechanism 58, when the loading lid 42 is set at a closed position, a position of the center of the roll core 41 is deposited at or near to the predetermined position independent of largeness of the radius of the paper roll 40. As shown in FIG. 6, when the paper roll 40 of the large radius that is not used is loaded, the open angle between the loading lid 42 and the holder plate 43 is large. Thereby, the center of the paper roll 40 is at the position shown in x=L1, y=H1 (where the length- and widthwise directions are determined to x- and y-directions). Further, as shown in FIG. 7, when the paper roll 40 of the small radius is loaded, the open angle is small. Accordingly, the first and second position regulate sections 59, 60 protrude more than those in FIG. 5, and the center of the paper roll 40 is at the position in x=L2 (≈L1), y=H2 (≈H1).

The effect of the present invention will be explained now. When the paper roll 40 is loaded in the thermosensitive color printer 2, a locking mechanism (not shown) of the loading lid 42 is released, and thereafter, as shown in FIG. 2, the loading lid 42 is opened to a predetermined position. Thereby, as the shift mechanism 55 is released such that the holder plate 43 may be free, the holder plate 43 is moved by the bias of the spring 61 to contact to the stopper 62. While the loading lid 42 is opened, the open angle between the loading lid 42 and the holder plate 43 becomes larger, and the pin 76 attached to one of the end of the connection link 68 slides downward in the groove 43*a*. Namely, the link mechanism 64 opens and the positioning plate 63 is retracted towards the loading lid 42. At the same time, the link mechanism 67 of the second position regulate section 60 opens, and the positioning plate 66 is retracted. When the paper roll 40 is put on the loading lid 42 in this situation, the paper roll 40 is supported by the positioning plates 63, 66.

Then, the loading lid 42 is closed. As shown in FIG. 5, as the holder plate 43 contacts to the stopper 62 and is stopped, the loading lid 42 moves toward the holder plate 43. Thereby the angle between the loading lid 42 and the holder plate 43 becomes smaller. Simultaneously, the link mechanism 67 closes and the positioning plate 66 moves forward. Further, as the link mechanism 64 is closed through the connection link 68, the positioning plate 63 protrudes from the loading lid 42 to push the paper roll 40 toward the holder plate 43. Then the paper roll 40 contacts to the positioning plate 63, and the link mechanisms 64 and 67 are fixed. Thus, the paper roll 40 is held by the loading lid 42 and the positioning plates 63, 66. When the loading lid 42 is closed furthermore, the holder plate 43 is rotated counterclockwise against the bias of the spring 61. Thereby the loading lid 42 and the holder plate 43 are rotated together while the open angle between them is kept corresponding to the largeness of the radius of the paper roll 40.

When the loading lid 42 is closed perfectly, the loading lid 42 is locked by the locking mechanism and kept in a closed position. The lid open/close sensor 52 outputs signals to the controller 7. When receiving the signals, the controller 7 drives the slide mechanism 46 to move the driven shaft 49 towards the paper roll 40, and the roll core 41 of the paper roll 40 is, regardless of the radius thereof, positioned at or near the predetermined position. Therefore, the driven shaft 49 can smoothly enter in the roll core 41. Further, the flange 51 presses the paper roll 40 toward the drive shaft 48, and the drive shaft 48 enters in the other end of the roll core 41. Thus the paper roll 40 is supported between the flanges 50, 51 by the paper roll shaft.

When the paper roll 40 is supported by the drive shaft 48 and the driven shaft 49, the holder plate 43 is rotated counterclockwise by the shift mechanism 55 to be apart from the paper roll 40. Corresponding to the moving of the holder plate 43, the open angular between the loading lid 42 and the holder plate 43 becomes larger, and the positioning plates 63, 66 becomes away from the paper roll 40. When printing is carried out, the drive motor 47 causes to rotate the paper roll 40. As the paper roll 40 is unwound, the thermosensitive color printing paper 8 is fed out of the paper feed section 3 to the printing section 4, and printing is made. Thereafter, a part where the printing has been made is cut into a sheet, and the sheet is fed out from the thermosensitive color printer 2.

In order to change the paper roll 40, the loading lid 42 is opened. Thereby signals from the lid open/close sensor 52 are input in the controller 7. The controller 7 drives the slide mechanism 46 to extract the driven shaft 49 from the roll core 41. Then, the shift mechanism drives to release the holder plate 43, and the holder plate 43 is rotated toward the loading lid 42 by the spring 61. Thereby the roll core 41 is extracted from the drive shaft 48, and then, the roll core 41 or the paper roll 40 in use is nipped by the positioning plate 63 and the holder plate 43. The holder plate 43 is rotated by the spring 61 in accordance with the opening of the loading lid 42, during which the holder plate 43 contacts to the stopper 62. Thereafter, only the loading lid 42 rotates to the open situation illustrated in FIGS. 2 and 5.

The flange 50 had better be biased by a spring to be slidable to the drive shaft 48. In this structure, when the driven shaft 49 is extracted from the roll core 41, the flange 50 is moved by the spring such that the roll core 41 may be pressed out of the drive shaft 48. Further, the loading lid 42 may be slidable.

The present invention is not applied only to the thermosesitive color printer in which the paper roll is used, but also may be applied to a ink jet printer in which a best quality paper roll is used, and a photo printer in which a photographic paper roll is used.

Various changes and modifications are possible in the present invention and may be understood to be within the present invention.

What is claimed is:

1. A printer for a printing paper roll in which a continuous printing paper is coiled, comprising:

a printer body for contacting a printing mechanism which prints on said continuous printing paper;

a loading lid openably attached to said printer body;

a position regulating device for setting said printing paper roll at a predetermined position when said loading lid is set to a closed position, said position regulation device being combined to said loading lid;

a detector for detecting said loading lid in a closed position; and a supporting device for rotatably supporting said printing paper roll in said printer body, said supporting device being inserted in said printing paper roll set at the predetermined position in accordance with output of a detection signal from said detector.

2. A printer described in claim 1, said position regulation device comprising:

a holder plate coaxially provided with the loading lid, an open angle between said holder plate and said loading lid being determined in accordance with largeness of a radius of said printing paper roll;

first and second link mechanisms attached to said printing paper loading lid and said holder plate, transforming in accordance with said opening angle; and first and second positioning plates attached to said first and second link mechanisms, for supporting a periphery of said printing paper roll.

3. A printer described in claim 2, wherein said first link mechanism is attached inside said loading lid, said second link mechanism is attached to said loading lid and said holder plate, and said open angle is determined by contacting of the periphery of said printing paper roll to said first and second positioning plates and said holder plate.

4. A printer described in claim 3, said first link mechanism comprising:

a first link having an end which is connected to said first positioning plate, and another end which has a first pin fitted in a first groove of said loading lid;

a second link connected to said first link to form an X-shape, an end of said second link having a second pin fitted in a second groove of said first positioning plate, another end of said second link being connected to said loading lid; and a connection link for moving said first link in accordance with said open angle, an end of said connection link being connected with said holder plate, and another end of said connection link being connected with said first pin.

5. A printer described in claim 4, said second link mechanism comprising:

a third link having an end which is connected to said second positioning plate, and another end which is connected to said holder plate;

a forth link connected to said third link to form an X-shape, an end of said forth link having a third pin fitted in a third groove of said second positioning plate, another end of said forth link being connected to said loading lid.

6. A printer described in claim 3, further comprising:

a spring biasing said holder plate toward said paper loading lid; and a stopper for preventing said holder plate from rotating during opening said loading lid.

7. A printer described in claim 6, said supporting mechanism comprising:

a first support shaft sliding in accordance with the detection signal of said detector, to be inserted into a side of a shaft hole of said printing paper roll; and a second support shaft to be inserted into another side of said shaft hole of said printing paper roll which is pressed and moved when said first support shaft is inserted in said shaft hole.

8. A printer described in claim 7, further comprising a shift mechanism for rotating said holder plate to be apart from said printing paper roll, after said supporting device supports said printing paper roll.

9. A printer described in claim 8, wherein said second support shaft is rotated by a motor so at to feed said continuous printing paper to the printing mechanism.

10. A printer described in claim 9, wherein each of said first and second supporting shafts has a flange which contacts to a side of said printing paper roll.

* * * * *